United States Patent [19]

Schneider-Muntau et al.

[11] 4,270,112

[45] May 26, 1981

[54] NORMAL CONDUCTIVE OR SUPERCONDUCTIVE MAGNET COIL

[75] Inventors: Hans-Jörg Schneider-Muntau, Meyland; Klaus Hackbarth, Sassenage, both of France

[73] Assignee: Max-Planck-Gesellschaft zur Förderung der Wissenschaften e.V., Gättingen, Fed. Rep. of Germany

[21] Appl. No.: 11,925

[22] Filed: Feb. 13, 1979

[30] Foreign Application Priority Data

Mar. 16, 1978 [DE] Fed. Rep. of Germany ..... 2811504

[51] Int. Cl.[3] ..... H01F 27/30

[52] U.S. Cl. ..... 336/197; 335/200; 336/60; 336/205; 336/207; 336/223

[58] Field of Search ..... 335/216, 299, 300; 336/197, 207, 60, 205, 222, 223, DIG. 1

[56] References Cited

U.S. PATENT DOCUMENTS

| | | | |
|---|---|---|---|
| 2,449,434 | 9/1948 | Whitman | 336/197 X |
| 2,654,583 | 10/1953 | Treanor | 336/60 X |
| 2,735,979 | 2/1956 | Cohen | 336/223 X |
| 3,026,492 | 3/1962 | Norbut | 336/197 X |
| 3,264,590 | 8/1966 | Trench | 336/60 |
| 3,786,387 | 1/1974 | Hori et al. | 336/197 X |
| 4,109,375 | 8/1978 | Lin et al. | 336/205 X |

FOREIGN PATENT DOCUMENTS

| | | | |
|---|---|---|---|
| 1488225 | 4/1969 | Fed. Rep. of Germany | 336/197 |
| 2328652 | 1/1975 | Fed. Rep. of Germany | 336/60 |
| 2349121 | 4/1975 | Fed. Rep. of Germany | 336/60 |
| 2523846 | 12/1976 | Fed. Rep. of Germany | 336/60 |
| 1132834 | 11/1968 | United Kingdom | 336/60 |

OTHER PUBLICATIONS

Colloques Internationaux C.N.R.S., No. 242, Physique Sous Champs Magnetiques Intenses Grenoble 18-20, Sep. 1974, "The Helix Project" Schneider-Muntau et al., pp. 98, 161-165.

Fifth International Conference on Magnet Technology (MT-5), Laboratori Naziona del CNEN Jul. 1975, "High-Field Magnets with Constant Stress", Schneider-Muntau et al. pp. 398-401.

1974 Wurzburg report, "The Helix Project," pp. 125-145.

"Design and Construction of the Inner Solenoid of ANU 30T Electromagnet", Journal of Physics E: Scientific Instruments 1972 vol. 5, P.O. Carden, pp. 663-666.

*Primary Examiner*—Thomas J. Kozma

*Attorney, Agent, or Firm*—Cushman, Darby & Cushman

[57] ABSTRACT

An improved normal or superconductive field coil constructed so that individual coils are both axially and radially stable. The individual coils are provided with a holding cylinder at each end with the conductor ends being fixed to the holding cylinder. In another embodiment an electrically insulating, reinforcing cylinder is fixed to the outer periphery of the coil.

16 Claims, 14 Drawing Figures

NORMAL CONDUCTIVE OR SUPERCONDUCTIVE MAGNET COIL

BACKGROUND OF THE INVENTION

The invention relates to a normal conductive or superconductive field coil comprising a plurality of concentric individual coils, mechanically and electrically separated from one another over their winding length.

Such field coils are particularly suitable as high field coils. A traditional solution of a high field coil is the so-called Bitter magnet in which slotted circular copper discs are stacked together with an insulating foil in such a way that a thick, single-layer helix is formed. In another known high field coil helically wound disc coils comprising a pretensioned strip of constant height and insulated, e.g. with a nylon band, are superimposed. It is also known to form individual wire-wound coils into a high field coil.

In these coils the individual coil parts or discs are secured to one another by screwing, casting or by similar attachment methods so that the strength of the thus formed coil former is generally sufficient to absorb the forces exerted by the electromagnetic fields determined by the Lorentz force density and the stresses caused by the fields, without there being any danger of damage to the coils or the coil former.

The Lorentz forces are dependent on the current density in the conductor. In the aforementioned coil types the current density distribution is constant over the coil radius. However, in Bitter magnets the radial current density distribution is inversely proportional to the radius, so that in the radially inner area of the coil there is a higher current density than in the radially outer area. Therefore in Bitter magnets the Lorentz forces proportionally dependent on the current density and consequently the mechanical stresses in the radially inner area of the coil are greater than in the radially outer area. As a result in Bitter magnets only those electromagnetic fields can be built up which in the radially inner area of the coil do not produce stresses which exceed the material-dependent tensile strength of the conductor material, whereby in this connection tangential and radial tensile stresses are of particular significance in the radially inner area. Therefore the size of the attainable fields is a strength problem but which, assuming a homogeneous hollow cylinder, has been solved with the aid of computers, so that distribution-like approximate solutions exist for the current density which reproduce the field distribution within the coils by a function.

As the Bitter magnet represents the conventional solution of a high field coil the prior art more particularly describes the further development of this high field coil type. It has been found that on the inner edge of the coil the radial tensile stress is much smaller than the tangential tensile stress and that the latter is significantly co-determined by the radial tensile stress. Thus, an effort is made to keep the radial tensile stress as small as possible, so as to also reduce the tangential tensile stress. This has been achieved with identical external dimensions by replacing one coil by two contacting concentric coils. Finally it has been found that the radial tensile stress is negligibly small if a very large number of thin individual coils are fitted into one another. In the extreme case, with an infinitely large number of coils of infinite thinness the radial tensile stress, independently of the radial current density distribution, is equal to zero and the tangential tensile stress can be determined on a radius r approximately as the product of the current density, the magnetic field and the radius.

These relationships substantially also apply to individual coils realizable with a finite thinness having a diameter ratio (external diameter to internal diameter) of e.g. 1:1. The tangential tensile stress is then only a few percent above the current density value resulting from the above relationship for the tangential tensile stress in coils of infinite thinness and is therefore lower to a factor of two or more than that of a traditional thick high field coil.

The measure of replacing a single thick coil by a plurality of concentrically nested, contacting or non-contacting coils is called mechanical separation. If these individual coils are also electrically insulated relative to one another by insulation, e.g. by a gap between them, reference is made to electrical separation. The latter leads to more favorable current density distributions, because it is possible to approximate stepwise virtually any desired radial current density distribution in that at the same current the wire dimensions or the superconducting part on the conductor is selected correspondingly for each individual coil. Thus, e.g. compared with a resistance magnet with constant current density the field produced is increased by 20% for the same external dimensions and same output if $J \sim 1/r^2$, J standing for the current density distribution and r for the radius of the coil.

In the case of superconducting coils account must also be taken of the fact that the maximum permitted current density is also dependent on the magnetic field, but here again the forces which occur, particularly in high field coils of $Nb_3Sn$ or $V_3Ga$ are important design parameters. In the case of a radial current density distribution guaranteeing the same maximum tangential tensile stresses in all individual coils volume economies of up to 50% are obtained compared with a single thick coil with constant current density, as a function of the field strength, dimensions and stability requirements.

As a result of the arrangement of a plurality of concentric individual coils separated mechanically and electrically from one another over their winding length the straining together or screwing of the individual coils to form a coil former is extremely difficult and complicated. Casting around would in fact eliminate the advantage of reducing forces. Thus, for example, in the case of a high field coil with mechanical separation of the individual coils it is known to secure the latter by a large number of bolts on their two faces in the axial direction. The bolts are guided and prestressed by a complicated and costly system of cylinders, pistons, rods, levers and rams. A radial fixing of the individual coils, as is necessary for an electrical separation thereof, is not immediately possible with the aid of the known fixing system, so that further complication of the known mounting system is necessary for this purpose. A further decisive disadvantage of the known field coil is that the power must be supplied via the mounting system or via the bolts, so that series resistors are necessary to balance the current.

SUMMARY OF THE INVENTION

The present invention solves the problem in connection with a field coil of the type indicated hereinbefore of maintaining the individual coils axially and radially stable, while permitting a direct current supply.

According to the invention this is achieved by providing each individual coil with a holding cylinder at its ends which projects axially over the winding form, and because the conductor ends of the individual coils are fixed to the holding cylinder and the individual coils are held thereon in stable manner.

The conductor ends, which may be exposed to high Lorentz forces can be adequately and simply secured by the holding cylinders. In addition, the holding cylinders provide an electrical insulation in the operating state of the field coil between the individual coils and the fixing means necessary for securing the same, so that the fixing means are not themselves live, making a current balancing, optionally by means of series resistors unnecessary. The holding cylinders also permit in a simple manner the securing of the individual coils in the area of the mounting support against axial and radial displacement and against twisting, because the means necessary for this, such as spacers which can be made from current-conducting material, do not impair the electrical separation between the individual coils. As for a radial fixing of the individual coils, it is sufficient to provide spacers at three or four points along the holding cylinder periphery, around the periphery and between the spacers openings are formed which are adequate for optionally introducing a coolant circulating between the individual coils. The holding cylinders create an adequate hydraulic inflow zone for the coolant. Finally the fastening according to the invention permits an easy replacement of any damaged individual coils, as well as the basis for a simple and easily supervised construction of the field coil, together with the basis of forming different individual coils in random manner to provide a field coil of desired field characteristics.

According to a preferred embodiment the holding cylinders are stuck to the end face surface of the winding of the individual coil. A special adhesive mixed with silanized glass balls with a diameter of about 0.1 mm can be used for adhesion purposes and also for sticking and insulating the individual turns. The individual coils are stuck together with the holding cylinders in a single operation. Subsequently the individual coil is exposed to a high axially directed pressure, so that between the turns and/or between the top and bottom turn and the holding cylinder spacers corresponding to the diameter of the glass balls used are created. Following curing of the adhesive the individual coils are machined over, so that the necessary tolerances for the individual coils are assured. However, it is also possible for at least one of the individual coils to have on its outer circumference a reinforcing cylinder made from a material having an electrically insulating action in operation. In this case the ends of the reinforcing cylinders can serve as holding cylinders if they project axially above the winding form. However, additional holding cylinders may also be used and optionally engage in the reinforcing cylinders. The reinforcing cylinders can also have the function of giving the coil former a greater rigidity.

For superconducting field coils with stabilization copper it is advantageous to use reinforcing cylinders made from high-grade steel and in their inwardly directed surfaces grooves are machined in which is placed the conductor material. The conductor material is preferably secured by adhesion. After sticking the inner surfaces are machined over so that the individual coils will have the requisite tolerances. The axial spacing between the grooves for receiving the conductor is dependent on the desired or required current density and can vary for each individual coil.

However, it is also possible to stick the conductor material directly in the manner of a self-supporting coil, whereby the generally cross-sectionally rectangular conductor is wound edgewise or flat or with the co-winding of a copper strip. In the first case the conductors are flat on their axially adjacent surfaces. In the second case also cross-sectionally round conductors can be used. In addition, even conductors with different dimensions and therefore current densities can be used, so that the individual coils correspondingly have different dimensions and therefore current densities.

In both cases reinforcing cylinders can be placed on the individual coils and are preferably stuck to the conductor material. A particularly advantageous method for fixing the reinforcing cylinders to the conductor material comprises the shrink-fitting of the cylinders, because this leads to a certain pretension resulting in an increased current carrying capacity of the conductor when stressed by the Lorentz forces and which reduces the effective current density.

An important advantage of the invention is that the field coil can be made from different individual coils, where at least some have a different current density. As a result it is possible to direct the current density in each individual coil, for example by the selection of corresponding conductor cross sections or of the conductor material or the like at a desired value, so that for example each individual coil is exposed to the same maximum permitted tensile stress. If the holding cylinders are applied to the top turn of the conductor they generally have the same or almost the same thickness as the conductor. Thus, even in the mounting area the gap provided between the individual coils is maintained, the gap permitting the introduction and circulation of a coolant. For the case that the holding cylinders have such a thickness that they are contiguous it is advantageous for introducing coolant to provide axially directed slots in that part of the holding cylinders projecting over the conductor cross section.

The invention makes it possible to optimize the height of each individual coil, so that it is possible to obtain efficient geometries of the complete coil. Thus, for example, a magnet with a current density distribution $J \sim 1/r^2$ produces the maximum field per power unit if it is given a trapezoidal (longitudinal) cross section (shown e.g. in FIG. 9). The field gain is then 36%. Such a geometry can easily be obtained with individual coils. As the length or height of each individual coil is dependent on the above-mentioned optimization calculations it is advantageous if the holding cylinders have different lengths, so that in simple manner the different lengths of the individual coils can be balanced to a more favorable uniform length for simple fixing. Due to the different lengths of the holding cylinders in the case of equally long individual coils, but which have different effective lengths more favorable, for example trapezoidal overall coil cross sections can be obtained inter alia for the fitting of the field coil.

A particularly advantageous stable mounting of the individual coils can be obtained by providing radial slots in the terminal, outwardly directed surfaces of the holding cylinders, whereby in said slots engage radial retaining ribs by which the individual coils are also held in stable manner in the circumferential direction. The use of radial retaining ribs is particularly advantageous because adequate access is then maintained for any coolant which may be necessary. The radial retaining ribs may be constructed as individual fixing bars secured in the field coil mandrel or can be combined to form a component shaped like a spoked wheel with or without an external rim. The latter construction is particularly advantageous because such components can be fitted to the terminal ends of the field coil and can be braced together so that in simple manner a force-locked, stable mounting of the individual coils is achieved.

If the retaining ribs are constructed in the form of individual bars it is advantageous for the radial fixing of the position of the individual coils if stops are shaped onto the ribs which maintain the radial spacing between the individual coils.

BRIEF DESCRIPTION OF THE DRAWINGS

The preferred exemplary embodiment of the present invention will be described in greater detail hereinafter relative to non-limitative embodiments and with reference to the drawings, wherein.

DETAILED DESCRIPTION OF THE PREFERRED EMBODIMENTS

Figure 1:
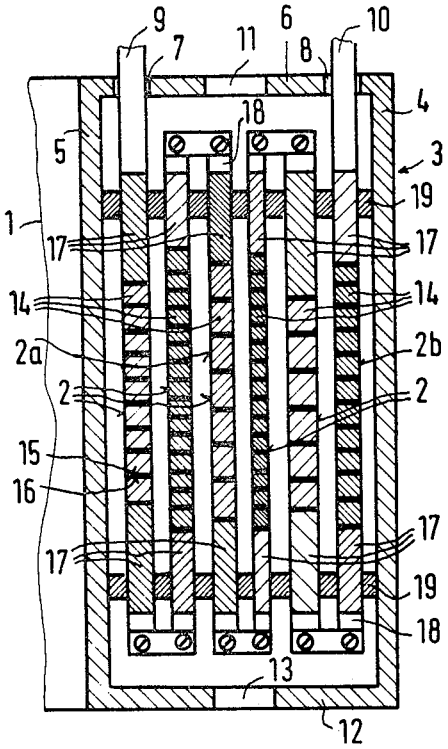
FIG. 1 is a diagrammatic longitudinal cross section through a high field coil according to the invention with different individual coils.

Turning now to the drawings, FIG. 1 shows the construction of a high field coil 1 as comprising a plurality of differently thick and long concentric individual coils which are mechanically and electrically separated over their winding length. The individual coils 2 are arranged in a housing, generally indicated at 3, with inner and outer walls 4 and 5, respectively being arranged concentrically to the individual coils, in a spaced manner, so that gaps are formed between them for an optionally provided coolant circuit. Housing 3 has in its end face cover 6 a radially inner opening 7 and a radially outer opening 8, through which current supply means 9 and 10 are placed with these current supply means 9 and 10 being respectively connected to the radially inner and radially outer individual coil. Furthermore, end face cover 6 also contains an inlet opening 11 for an optionally necessary coolant. An outlet opening 13 for the coolant is provided at a convenient location in the bottom 12 of housing 3.

The individual coils 2 comprise conductors 14 which have a substantially rectangular cross section. Conductors 14 are wound either edgewise, as in the case of coil 2*a* or they are wound flat as in the case of coil 2*b*. The axially adjacent surfaces 15 and 16 of conductor material 14 are flat. Holding cylinders 17 which have different lengths corresponding to that of individual coils 2, are provided on the ends of each individual coil. The individual coils 2 are electrically interconnected pairwise via conductor ends 18 in the manner of a series circuit. The conductor ends 18 of the radially inner and radially outer individual coil are connected to the power supply means 9 and 10 respectively. The conductor ends are connected in a conventional manner, for example, by means of the screw fastening shown in FIG. 1.

The individual turns of the conductor material are stuck together and holding cylinders 17 are also stuck to the end surface of the winding of individual coil 2. The adhesive used for this is mixed with silanized glass balls having a diameter of approximately 0.1 mm. The individual coils 2 are stuck in a single operation together with the holding cylinders 17. Each individual coil 2 is then exposed to a high, axially directed pressure, so that between the turns or between the top and bottom turns and the holding cylinder 17 spaces are created corresponding to the diameter of the glass balls mixed with the adhesive. After curing the adhesive the individual coils 2 are machined so that the requisite tolerances of coils 2 are assured.

The stable mounting of individual coils 2 in housing 3 is achieved by providing holding arms 19 which are secured in stable manner relative to housing 3 in such a way that they engage in corresponding bores (not shown in FIG. 1) in the inner and outer walls 4 and 5. The fixing of individual coils 2 achieved by holding arms 19 will be described in greater detail hereinafter.

Since, as is apparent from FIG. 2, holding arms 19 are constructed in the form of radially directed bars by which the individual coils, as will be shown hereinafter, can be radially fixed in a spaced manner from one another, adequate accesses are provided in the fixing area of the individual coils for any coolant which may be necessary and which circulates between the individual coils 2. Due to the large areas over which the coolant can flow an extremely efficient cooling of the field coil can be achieved.

Figure 2:
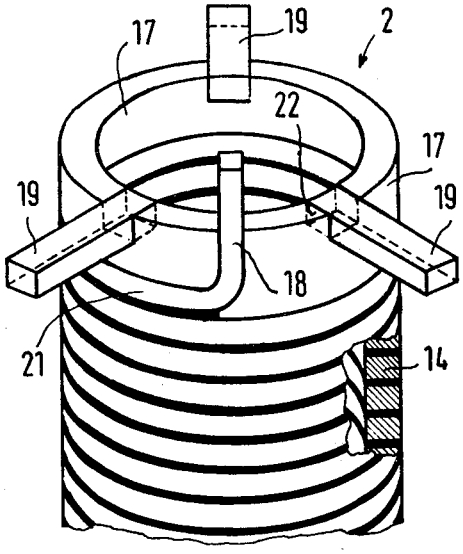
FIG. 2 is a perspective view of an individual coil with part broken away to show a partial section.

FIG. 2 shows a perspective view of the construction of an individual coil 2. Conductor end 18 is inserted in holding cylinder 17 and passes out of the cylinder at the top. The holding cylinder is correspondingly slotted, the conductor end running along this slot and on the radially inner and outer sides terminates flush with the inner or outer surface of the holding cylinder 17. The power supply means 9 or 10 or a connection to the adjacent individual coil can be connected to the conductor end. Holding arms 19 engage slots 22 formed in the terminal surfaces of holding cylinder 17 and in the field coils shown in FIG. 2, three uniformly circumferentially distributed holding arms 19 are provided. To ensure that individual coils 2 are also secured radially one relative to one another the holding arms 19 can have spacing projections (not shown in FIG. 2) which fit between the holding cylinders 17 and which have a radial width ensuring the correct spacing relative to the adjacent coil.

Figure 3:
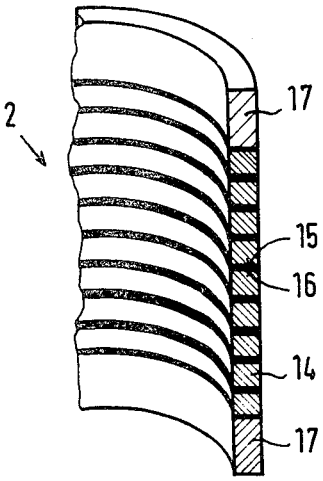
FIG. 3 is a detailed partial perspective, partially in section, of an individual coil.

FIG. 3 shows an individual coil 2 wound from a cross-sectionally rectangular conductor 14 with a holding cylinder 17 being stuck to each of its coil ends.

Figure 4:
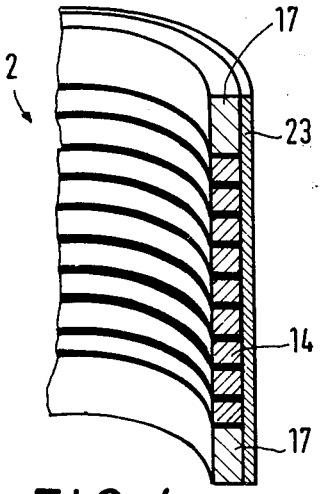
FIG. 4 is a detailed partial perspective, partially in section, of an individual coil provided with reinforcing cylinder.

In the case of the individual coil 2 of FIG. 4 a reinforcing cylinder 23 made from a material having an electrically insulating action in operation engages on the outer periphery thereof. The reinforcing cylinder 23 can be stuck or shrink-fitted to the individual coil former comprising conductor material 14 and holding cylinders 17. The material of reinforcing cylinder 23 is dependent on whether there is a normal conductive or superconductive field coil. In the case of a normal conductive field coil the reinforcing cylinder is comprised of conventional material capable of insulating at ambient temperature, while in the case of superconducting field coils, the reinforcing cylinder is made from a material capable of insulating at cryogenic temperatures, for example high-grade steel.

Figure 5:
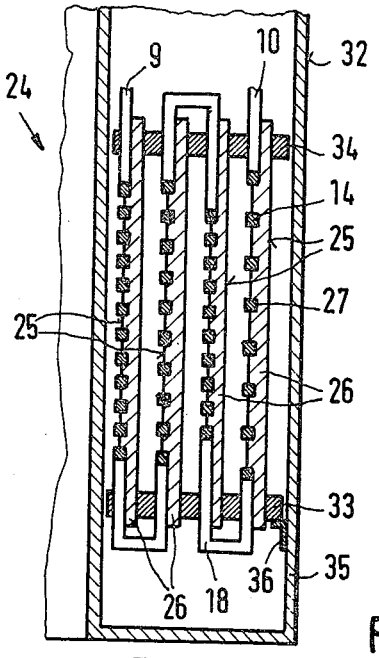
FIG. 5 is a longitudinal cross-sectional view through another embodiment of a field coil according to the present invention.

In the embodiment of magnet 24 shown in FIG. 5 the turns of the individual coils 25 are at least partly embedded in grooves 27 formed in reinforcing cylinder 26. This construction is particularly suitable for superconductive coils, so that the reinforcing cylinder is preferably made from high-grade steels. Slots 27 are helical grooves machined into the inwardly directed surface of reinforcing cylinder 26 and into which the conductor is preferably stuck.

Figure 7:
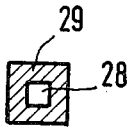
FIG. 7 is a detailed cross-sectional view of conductor material that can be used in a field coil according to the present invention.
Figure 8:
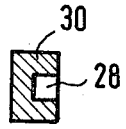
FIG. 8 is a detailed cross-sectional view of conductor material that can be used in a field coil.

The conductor preferably has the cross sections shown in FIG. 7 where the superconductor 28 is completely surrounded by stabilization copper 29 or as shown in FIG. 8 where the superconductor 28 is only partly surrounded by stabilization copper 30 which has a substantially U-shaped cross section.

In the embodiment shown in FIG. 5, the inner surfaces of individual coils 25 are also machined after adhesion of the turns in order to obtain individual coils with clearly defined tolerances. The spacing between slots 27 is dependent on the requisite current density and can differ for each individual coil, as can be seen from FIG. 5 in a comparison of the radially outer and radially inner individual coil.

In the embodiment of FIG. 5 there is no need for holding cylinders because the reinforcing cylinders 26 assume the function of the holding cylinders. Also, the conductor ends are fixed to the inwardly directed surface of the reinforcing cylinder, e.g. by adhesion. Once again the individual coils 25 are fixed in housing 32 by holding arms 33 and 34, with holding arms 33 being supported by support 36 located on wall 35 of housing 32. As a result of this fixing procedure for the lower holding arms 33 the assembly of magnet 24 is simplified since the difficulties encountered when fixing holding arms 33 and 34 in bores provided in the outer walls is obviated. Further, there is the option of double centering and tolerance imprecisions between the support and the bores for the upper holding arms 34 can be compensated in a simple manner.

Once again the individual coils 25 are electrically interconnected in series by means of their conductor ends, so that the conductor end of the radially inner individual coil and the radially outer individual coil pass upwards out of the magnet 24 as power supply means.

Figure 6:
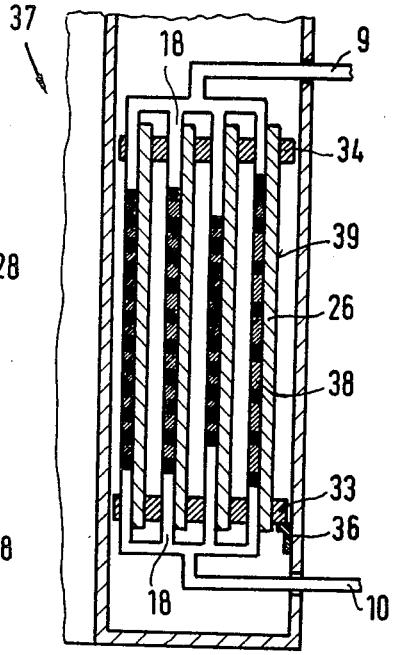
FIG. 6 is a longitudinal cross-sectional view through still another embodiment of a high field coil according to the present invention.

In the case of magnet 37 shown in FIG. 6, conductor 38 is adhered to a self-supporting individual coil 39 and the conductor can be wound either edgewise or flat or with the co-winding of a copper strip. As is apparent from FIG. 6 the individual coils 39 can have a reinforcing cylinder 26 on their outer periphery, the reinforcing cylinder being stuck or shrink-fitted to the individual coil. It is also possible to use conductors with different dimensions and consequently different current densities for the individual coils 39, which will then have different thicknesses. Here again it is possible to machine the inner and outer surfaces of the individual coils 39 following adhesion. The mounting of the individual coils in the field coil takes place in much the same way as in the magnet shown in FIG. 5.

The individual coil connections can also be individualized and connected to their own, individual, power supply units, so that different currents and consequently different current densities can be set in the individual coils 39.

In the embodiment shown in FIGS. 5 and 6 helium is used as the coolant, in the case of superconductive field coils. In this case the adhesive used for adhesion purposes is selected in such a way that it ensures an adequate strength of the individual coils 39 for cryogenic temperatures.

FIGS. 9 to 13 in particular show different embodiments of the preferred holding arms used for the stable fixing of the individual coils. For ease of viewing the same hatching is used in the drawings for the conductor cross sections of all the individual coils, as well as the holding cylinders of all individual coils, although separate parts are involved.

Figure 9:
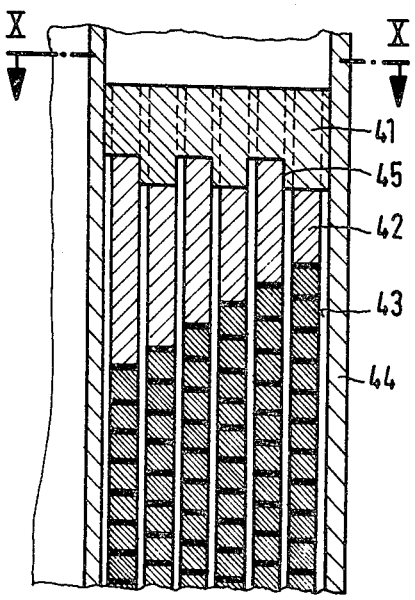
FIG. 9 is a partial longitudinal cross-sectional view of a further embodiment of a field coil according to the present invention with individual coils of different lengths.
Figure 10:
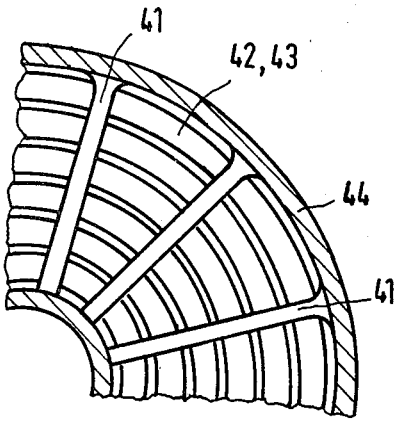
FIG. 10 is a top plan view of the field coil shown in FIG. 9 along the line X—X.
Figure 11:
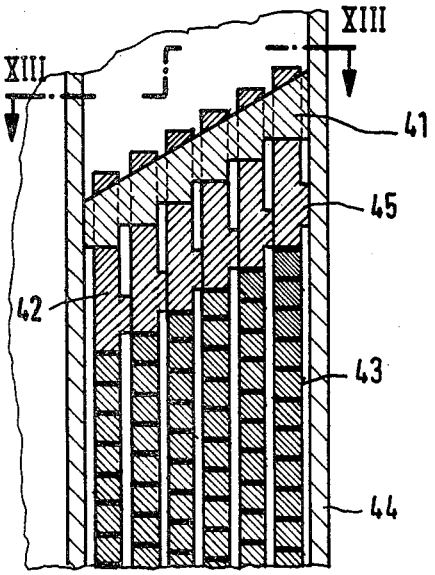
FIG. 11 is a partial longitudinal cross-sectional view of a further embodiment of a field coil according to the present invention with individual coils of different lengths and holding cylinders with the same length.
Figure 12:
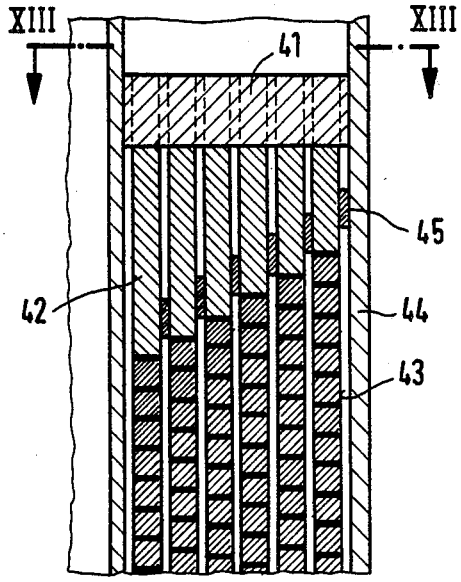
FIG. 12 is a partial longitudinal cross-sectional view of still a further embodiment of the present invention with individual coils of different lengths and holding cylinders of the same length.

As can be gathered from the drawings holding arms 41 and holding cylinders 42 can follow the contour of individual coils 43 (see FIG. 11). However, it is also possible for only those ends of the holding cylinders 42 adjoining the coils 43 to follow the contour of individual coils 43, while the holding arms are horizontally directed, as shown in FIGS. 9 and 12. To secure individual coils 43 against twisting and displacement in the axial direction slots are provided in holding cylinders 42 or holding arms 41 which engage the holding arms in the first case and the holding cylinders in the second case. The upper and lower holding arms 41 are mechanically interconnected, e.g. by the magnet housing 44. To secure the individual coils 43 against radial displacement the holding cylinders 42 can carry spacers 45 which are integrally constructed therewith and which project radially from the cylinders 42 to such an extent that in each case they come into contact with the holding cylinder of the adjacent individual coil. Where spacers 45 are not an integral component of holding cylinders 42 they can be constructed in the form of distance pieces stuck to the cylinders 42 at the corresponding points.

Another possibility for the fixing of the individual coils 43 is shown in FIG. 9. For the maximum mechanical decoupling of individual coils in this embodiment the slots in holding cylinders 42 and holding arms 41 are arranged in such a way that a toothing system occurs between arms 41 and cylinders 42. In this embodiment the spacers 45 for the radial fixing of the individual coils are in integral component of holding arms 41.

Figure 13:
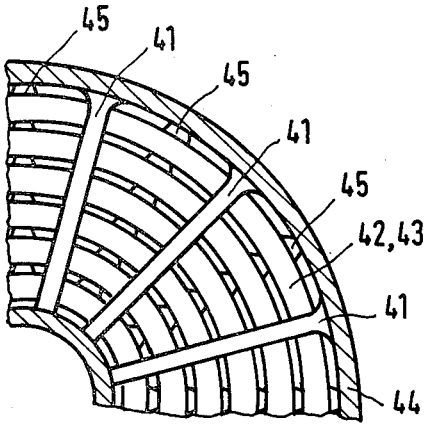
FIG. 13 is a partial top plan view taken along line XIII—XIII in FIGS. 11 and 12.

FIG. 13 in particular shows the arrangement of spacers 45.

Figure 14:
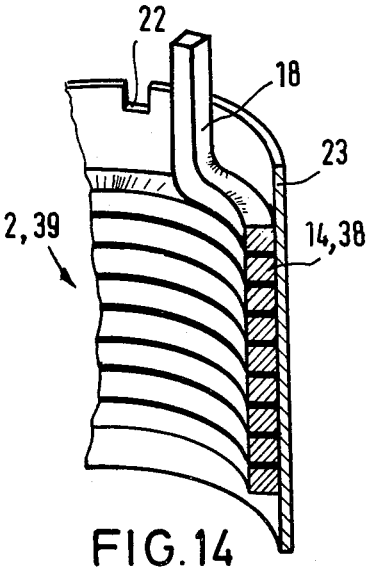
FIG. 14 is a detailed partial perspective, partially in section, of an individual coil with a reinforcing cylinder projecting over the winding length thereof.

In the embodiment of FIG. 14 the reinforcing cylinder 23 assumes the function of the holding cylinder, the conductor end 18 of the individual coil being stuck to the inwardly directed surface of the reinforcing cylinder. In this case the slots 22 necessary for receiving holding arms 19 are located in the reinforcing cylinder 23.

The above-described fixing of the individual coils makes it possible to effect the mechanical and electrical separation of the individual coils in the case of a magnet as defined hereinbefore. In addition to reducing the tensile stress it provides the possibility of freely selecting the current density and the axial length of each individual coil and thus adapt it to the current carrying capacity of the superconductor, which is in turn dependent on the magnetic field and the length changes of the superconductor resulting from the tensile stresses.

The invention is not limited to the embodiments described and represented hereinbefore and various modifications can be made thereto without passing beyond the scope of the invention.

What is claimed is:

1. A high field magnet coil for generating high magnetic fields, the magnet coil being comprised of helical conductor turns so as to have a substantial radial thickness wherein the magnet coil is radially subdivided into a plurality of cylindrical thin individual coils, concentrically nested one inside another, each of said individual coils being comprised of a single conductor turn layer that is maintained both mechanically and electrically separated from adjacent individual coils throughout the length of its conductor turns so as to define a gap between all adjacent coils throughout their conductor turn layers, each individual coil having at each axial end a conductor end portion axially projecting beyond its conductor turn layer, each individual coil having two holding cylinders, one at each axial end, which extend axially beyond the conductor turn layer, each of said conductor end portions being fixed to a respective one of said holding cylinders, each coil together with a holding cylinder at each axial end comprising an individual, self-supporting structure in which the conductor turns throughout the turn layer of the coil and the holding cylinders are bonded together by a mechanically strong adhesive, such that the conductor turns are equidistantly spaced from each other throughout the turn layer; the assembly of said plurality of coils being held together by holding means for axially, radially and circumferentially fixing said plurality of coils in place, said holding means engaging the holding cylinders and being common to all coils so that said holding means individually acts on each coil at both axial ends thereof.

2. A field coil according to claim 1 wherein at least one of said individual coils has an electrically insulating reinforcing cylinder connected to the outer periphery thereof.

3. A field coil according to claim 1 wherein the turns of each individual coils are stuck directly to one another.

4. A field magnet coil according to claim 1 wherein the adhesive between the conductor turns of each individual coil is mixed with silanized glass balls of equal diameter to thereby assume the equidistant spacing of the conductor turns.

5. A field coil according to claim 2 wherein the reinforcing cylinder is connected by means of an adhesive.

6. A field coil according to claim 2, wherein the reinforcing cylinder is connected by being shrink-fitted into position.

7. A field magnet coil according to claim 1 wherein at least part of the individual coils have different current densities to optimize the maximum permitted tensile stress for each individual coil.

8. A field magnet coil according to claim 7 wherein said different current densities are effected by providing at least some of the individual coils with different cross shapes.

9. A field coil according to claim 1 wherein the holding cylinders have different lengths.

10. A field coil according to claim 1 wherein holding cylinders are placed in the reinforcing cylinders.

11. A field magnet coil as in claim 1 wherein the holding cylinders have axially extending grooves in the ends thereof and said holding means comprise radially extending retaining arms engaged within said axially extending grooves.

12. A field magnet coil as in claim 11 wherein said holding means further include radially extending shoulder portions at said retaining arms for spacing apart the individual coils.

13. A field magnet coil as in claim 11 wherein said holding cylinders include radially extending projections for engaging at least one adjacent holding cylinder for spacing apart the individual coils.

14. A field magnet coil as in claim 7 wherein said different current densities are effected by employing a different material in forming at least some of said individual coils.

15. A field magnet coil as in claim 1 wherein the length of the turn layers in at least some of the individual coils vary with the holding cylinders for such individual coils varying in axial length in a complementary manner so that each of the individual coils and its holding cylinders are of a substantially uniform axial length.

16. A field magnet coil as in claim 1 wherein the holding cylinders have the same cross-section as the turn layers in said individual coils and wherein said holding cylinders are provided with means defining an axially extending slot extending there through and said conductor end portions are secured within said axially extending slot so that said conductor end portions are positioned flush with the surfaces of said holding cylinder.

* * * * *